United States Patent [19]

Blanchard

[11] 3,981,401

[45] Sept. 21, 1976

[54] COVER FOR PLATES AND STACKING DEVICES THEREFOR

[75] Inventor: Richard Lewis Blanchard, St. Charles, Ill.

[73] Assignee: American Can Company, Greenwich, Conn.

[22] Filed: Mar. 14, 1975

[21] Appl. No.: 558,460

[52] U.S. Cl. ..... 206/508; 206/519; 220/380

[51] Int. Cl.[2] ..... B65D 21/02

[58] Field of Search ..... 206/508, 505, 507, 515, 206/518, 519, 520; 220/380

[56] References Cited

UNITED STATES PATENTS

| | | | |
|---|---|---|---|
| 2,776,772 | 1/1957 | Itoda | 206/519 |
| 2,994,457 | 8/1961 | Fornas | 206/520 |
| 3,170,594 | 2/1965 | Nascher | 206/507 |
| 3,303,964 | 2/1967 | Luker | 206/519 |
| 3,615,039 | 10/1971 | Ward | 206/518 |
| 3,883,036 | 5/1975 | Mahaffy | 206/519 |

*Primary Examiner*—George E. Lowrance
*Attorney, Agent, or Firm*—Robert P. Auber; Ira S. Dorman; Ernestine C. Bartlett

[57] ABSTRACT

Effective means for insuring predetermined axial spacing between parts in stacks, particularly in stacks of nesting, relatively large, thin-walled flexible parts and for maintaining positive alignment of the parts in stacks without causing undue difficulty when parts are being separated are provided. More specifically, plastic covers for plates or the like having specially constructed stack shoulders and stack stabilizers are provided.

6 Claims, 9 Drawing Figures

FIG. 3
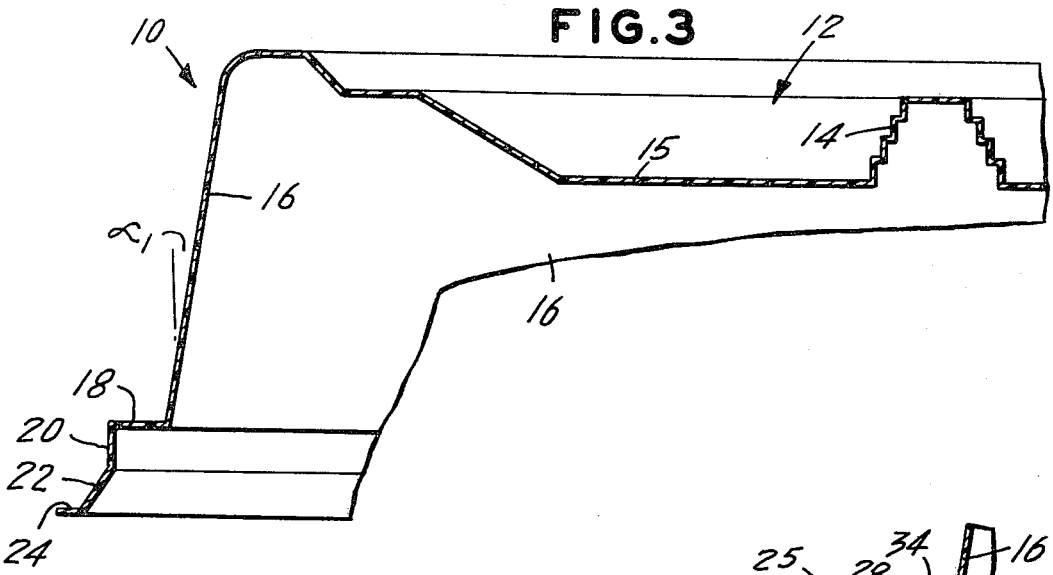
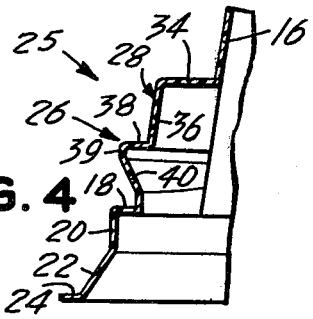
FIG. 4
FIG. 5
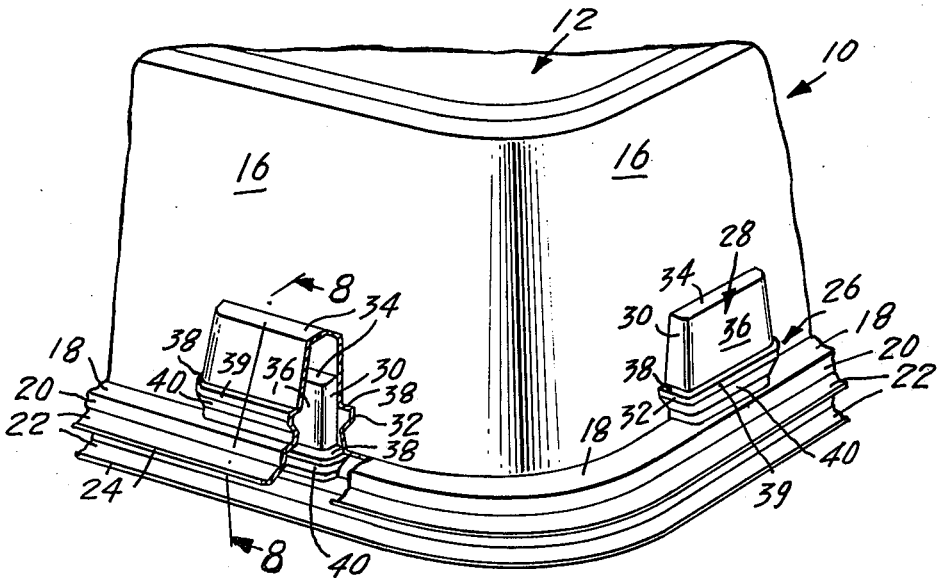

COVER FOR PLATES AND STACKING DEVICES THEREFOR

BACKGROUND OF THE INVENTION

In stacks of thermoformed parts, stack shoulders and other stacking devices are most effective if kept in vertical alignment within any given stack of parts. In many thin-walled thermoformed cups, for example, the stack device forms a continuous ledge around the cup. The cups are usually round and relatively small in diameter. This provides a minimal chance for stack shoulders to become misaligned.

Use of various types of stack shoulders including those of the reverse taper type is well known in the design of relatively thin-walled formed plastic articles such as drinking cups, dairy product containers, semi-rigid formed plastic meat packages and the like. The shape, size, location in part and degree of interference between stack ledges may vary widely since, for such relatively small parts, the undercut that can be pulled from commercial forming tools is sufficient to provide effective axial spacing control means. In items such as covers for plates however, the parts are relatively large with thin, relatively straight side-walls. In this type of large, flexible part, telescoping of one part within another is common and difficult to avoid for a number of reasons. For example, in parts that are nestably stackable, it is desired that minimal clearance between stacked parts be provided to reduce the stack height and thus reduce the space needed (and accompanying expense) during handling, shipping and storage of the parts. Although desirable, the amount that clearance can be reduced between parts and still permit satisfactory separation is limited. Such limits are imposed by several factors including the uniformity of material distribution in the sidewalls and the uniformity of the size and shape of parts being stacked. Additionally, as parts are separated from stacks, partial vacuum created between parts increases as clearance decreases and as the rate of separation increases making ready separation proportionately more difficult and often impossible. Another difficulty when using a reverse taper type shoulder, is that the undercut, i.e. those areas cut back or indented into the interior walls of the molds that correspond to the extended exterior portions of the stack shoulder, per side required to provide adequate resistance to telescoping between nested parts increases as 1) clearance between sidewalls of nested parts increases, 2) flexibility of sidewalls increases and 3) variation in dimensions and shape of nested parts increases. However, in relatively large, thin-walled flexible formed parts with stack shoulders placed near the open end of the sidewall, the undercut that can feasibly be produced at a reverse taper section of non-split forming tools is usually less than that required to provide effective telescope resistance. Since the amount of clearance between parts and the undercut permitted are also affected by variations in forming tools, process conditions and plastic material used, it will be appreciated that the production of such parts having adequate resistance to telescoping is imprecise and difficult to obtain.

Many proposals are present in the prior art directed to prevention of telescoping in stacked parts. Many of such proposals include stack ledges that are varied in shape, placement or spacing from one part to another in a stack or, where uniformly shaped and spaced, necessitate rotation of parts circumferentially in relation to adjacent parts to prevent telescoping. Where the undercut required is less than what can be feasibly produced on non-split commercial tooling, split tooling has been employed to permit stripping and removal of deeply undercut sections therefrom.

SUMMARY OF THE INVENTION

This invention relates to improved stacking means which insures predetermined axial spacing between parts in stacks without the need to either rotate parts circumferentially in relation to adjacent parts or to provide variation in shape, placement or spacing of stack shoulders or to use split tooling to allow removal of parts from the mold. The axial spacing control means of this invention are applicable to parts that are asymetrical about a central vertical axis as well as those that are symmetrical and are particularly effective on relatively large, thin-walled flexible nestably stackable parts. The axial spacing control means can be identical on all like parts and can be stripped from commercial forming tooling without the need to split tooling to allow removal of deeply undercut sections.

The improved stacking means of this invention comprises either 1) in combination, axial spacing control means and a stack stabilizer having returned sides that maintain contact of nested parts to minimize horizontal shift, said stabilizer limiting the accumulation of clearance at any point around the periphery of one part in relation to another part in a stack by providing minimal clearance between sidewalls of nested parts at sections of minimal overlap; or 2) a reverse taper stack shoulder section having returned sides which provide an extended offset that maintains contact during horizontal shift and especially horizontal shift that is greater than the undercut at the face of the stack shoulder, or 3) the combination of said stack stabilizer wherein the axial spacing control means is said stack shoulder.

DESCRIPTION OF THE DRAWING

FIG. 3 is an enlarged fragmentary section taken along line 3—3 of FIG. 1;

FIG. 4 is an enlarged fragmentary cross-sectional view of the stacking device and cover taken along line 4—4 of FIG. 1;

FIG. 5 is an enlarged fragmentary perspective view of a modified form of stacking device and cover of FIG. 1 in stacked relationship with another such cover;

Figure 1:
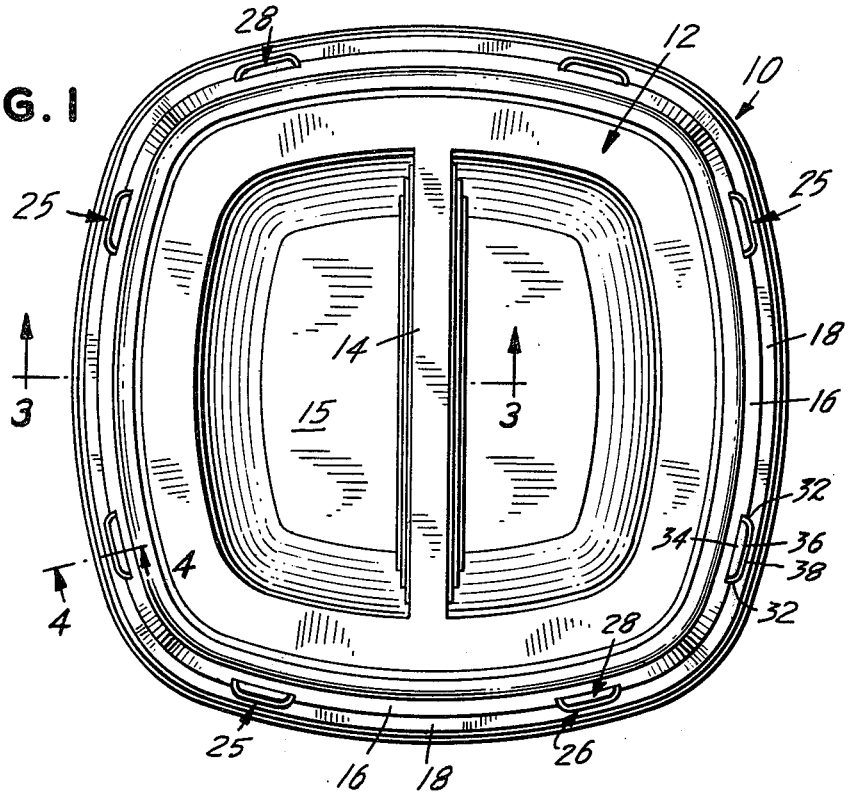
FIG. 1 is a top view of a plastic cover including the stacking means constructed according to the principles of this invention.
Figure 2:
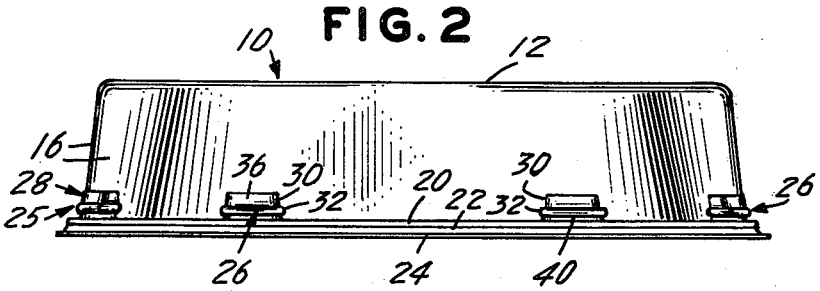
FIG. 2 is a side elevational view of the cover of FIG. 1.

Referring now more particularly to the drawings, there is shown in FIGS. 1, 2 and 3 a relatively large, thin-walled flexible plastic cover 10 including a top wall 12. A sidewall 16 is peripherally integral with top wall 12 and depends downwardly and outwardly therefrom at an angle $\alpha_1$ with the vertical axis of the main body of the cover.

Top wall 12 preferably includes a handle 14 and recess 15 therefor. The cover further includes a plurality of peripheral flanges 20, 22 and 24 extending generally outwardly adjacent the lower end of the sidewall terminating with the trimmed flanged 24. Entry flange 22 provides a lead-in guide when placing the cover on plates or similar articles while an intermediate flange 20 provides stability of the covers on the plates. Flange 20 additionally includes a horizontal offset 18 which provides a wide bearing surface on the plate to compensate for variation in plate sizes and cover fit.

The novel stacking devices of the invention may be either a stack shoulder having returned sides, a stack stabilizer having returned sides in combination with any of conventional axial spacing control means and in its preferred embodiment, combinations wherein said stack shoulder is the axial spacing control means employed with said stack stabilizer.

Figure 6:
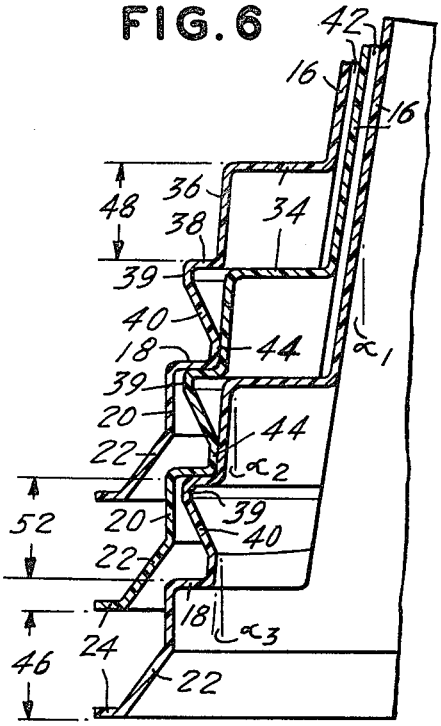
FIG. 6 is an enlarged vertical cross-sectional view taken along line 4—4 of FIG. 1 in stacking relationship.
Figure 7:
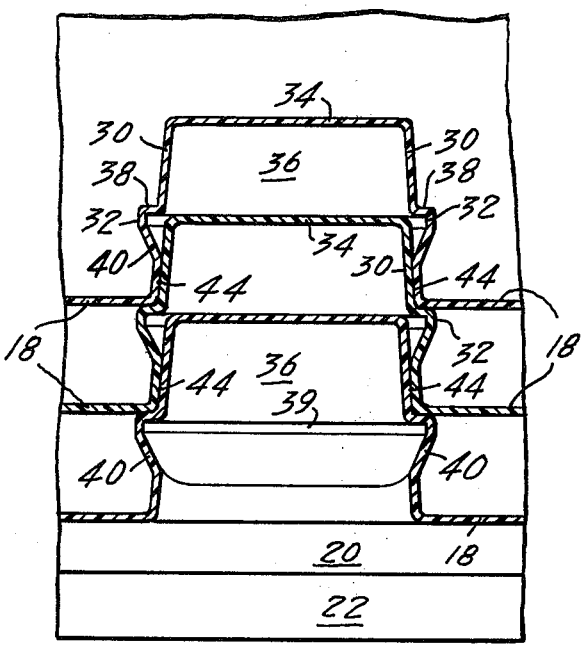
FIG. 7 is an enlarged vertical cross-sectional view of the stacking device of FIG. 6 as seen from inside the cover.

In its preferred embodiment, the stacking devices 25 of the invention comprise a plurality of stacking shoulders 26 and stack stabilizers 28 having returned sides 30 and 32, respectively as best seen in FIGS. 2, 6 and 7. The stacking device may desirably be located in the lower regions of the side wall and may vary in number as desired. In the embodiment illustrated, eight of such devices, two per side are used although fewer or more of such devices may be present. Additionally, as discussed further hereinbelow, the height and angles of the stack stabilizer may be varied as necessary to convey predetermined amounts of clearance or interference at predetermined points of engagement between stack stabilizer with a like stack stabilizer or between a stabilizer and a stack shoulder of different nested parts, such variations being best seen in FIGS. 6 and 7 where stabilizers and shoulders interfere and in FIGS. 8 and 9 where only the stabilizers interfere.

As best seen in FIG. 4, each stacking device 25 comprises (a) a stack stabilizer 28 having a generally horizontally disposed first member 34 extending from the side wall which is defined by the top of the stack stabilizer 28 and a downwardly depending straight portion 36 which is defined by the face of the stack stabilizer; and (b) a stack shoulder 26 having a horizontally disposed first part constituting a ledge 38 and a reverse tapered member 40 extending inwardly and downwardly and merging into the horizontal offset 18 of flange 20.

The returned sides of the stack stabilizer and shoulder, 30 and 32 respectively, are best seen in FIGS. 5 to 9 and can still be engaged and function to prevent telescoping and jamming of parts after the face 39 of the stack shoulder is completely dislodged, which condition in the absence of the returned sides, would allow telescoping.

The relatively large thin walled plastic covers used for purposes of illustration herein have an average clearance per side of 0.011 inch between main sidewalls of nested parts illustrated by 42 in FIG. 6 and a clearance of 0.0 inch between sidewalls of nested stack stabilizers as seen by 44. These amounts of clearance are predetermined and built into the cover by employing the following formulas:

To determine 42, clearance between nested main sidewalls,:

$$d = \text{sine } \alpha(S) - t \qquad 1.$$

and to determine 44, clearance between nested stack stabilizers,:

$$\text{sine } \alpha = t/S \qquad 2.$$

wherein:

$d$ = clearance per side between sidewalls of nested parts (42 in FIG. 6);

$\alpha$ = sidewall angle from vertical axis of section being considered (See FIGS. 3, 6 and 8) with $\alpha_1$, $\alpha_2$ and $\alpha_3$ designating the angle of the specific section. Thus $\alpha_1$ = the sidewall angle of the main body, $\alpha_2$ = sidewall angle from vertical axis of stabilizers and $\alpha_3$ = angle of sidewall in which the stack shoulder is cut;

$S$ = axial spacing between nested parts (46 in FIG. 6) and $t$ = thickness in sidewall of section being considered.

Figure 8:
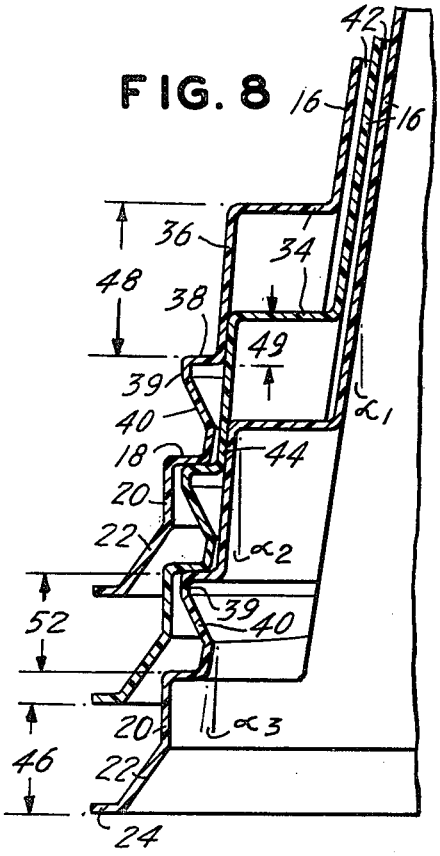
FIG. 8 is an enlarged vertical cross-sectional view of a modified stack device taken along line 8—8 of FIG. 5.
Figure 9:
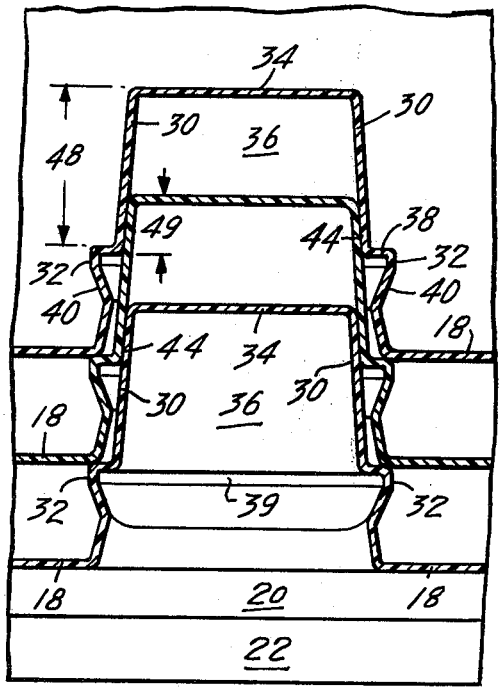
FIG. 9 is an enlarged vertical cross-sectional view of the modified stack device of FIG. 8 as seen from inside the cover.

As an example, with reference to the construction illustrated in FIGS. 8 and 9 using the following specifications, calculations for sidewall clearance 42 and the sidewall angle at the stack stabilizer ($\alpha_2$) necessary to provide 0.0 inch clearance in overlap area 49 between sidewalls of nested stack stabilizer sections may be made. Where the wall thickness is 0.012 inch, the sidewall angle $\alpha_1$ of the main body of the part is 8°, and axial spacing 46 between nested parts is 0.162 inch:

$$d = \text{sine } 8° (0.162) - 0.012,$$

$$d = 0.01069$$

In this case, average clearance per side would be considered to be 0.011 inch. Similarly, the sidewall angle $\alpha_2$ required to provide 0.0 inch clearance between sidewalls of nested stack stabilizers would be:

$$\text{sine } \alpha_2 = t/S$$

$$= 0.012/0.162 = 0.07407$$

$$\alpha_2 = 4° \ 14' \ 53''$$

In this case, the angle required to provide zero clearance is considered to be 4° 15′ as seen in $$d = \text{sine } \alpha_2 (S) - t$$

$$d = 0.07411 \ (0.162) - 0.012$$

$$d = 0.00001$$

Additionally, in these calculations, the overall height of the stack stabilizer 48 in FIG. 8 was set at 0.242 inch to provide an 0.080 inch overlap 49 between the top of one nested stack stabilizer means within the other.

It is the function of the stack stabilizer to prevent one nested part from shifting laterally in relation to adjacent parts and to insure that clearance per side remains as predetermined and that axial spacing remains in the desired degree of engagement. In the absence of the stack stabilizer, the extent of control of lateral movement of the parts in the stack would be limited to the exterior sidewalls and clearance at one side could accumulate up to twice that desired. Under these conditions, although there could be zero clearance between one side of nested parts, engagement of the stack shoulders on the opposite side would be reduced and, once sufficient shift took place, the stacking ledges of the stack shoulder would become less effective and telescoping of nested parts might occur more readily than if the stabilizer were not present.

The stacking device of the invention allows for provision of varied functions by its components either separately or in combination. The stack shoulder 26 with returned sides 32 functions to insure that motion of one stack shoulder relative to another will not result in telescoping since the returned sides can still be in contact when the outer face 39 of the ledge 38 is completely dislodged. The stack stabilizer 28 with returned sides 30 limits the accumulation of clearance at any given spot around the periphery of one part in relation to the next part in a stack while the combination of the stack shoulder and stabilizer results in the most effective stacking device since it combines these functions and provides for variation in points of engagement and amount of clearance or interference as illustrated in FIGS. 6 to 9.

It will be understood that geometric values other than those given above for determining the sidewall angles in the stack to provide 0.0 clearance between nested parts may also be varied and the same effect may be obtained. For example, if 0.250 inch axial spacing 46 is required to provide desired handling characteristics when unstacking the nested parts and clearance 42 between the sidewalls of the main body of nested parts is 0.023 inch, then the height of similar stack stabilizers 48 necessary to provide a 0.080 inch overlap 49 would equal 0.250 + 0.080 or 0.330 inch. The sidewall angle then, employing equation (2), would equal 2° 45′.

The following table is given to illustrate variations of the sidewall angle $\alpha_2$ of straight-sided stack stabilizers required to give 0.0 clearance with varied axial spacing 46 between nested parts using 0.012 inch thick sidewalls at 8° taper ($\alpha_1$ on FIG. 3) on the main body of the part with the height of the stack stabilizer 48 means being equal to the axial spacing plus the overlap. The clearances between sidewalls 42 are also shown.

| Angle straight sided | Axial Spacing | Sidewall Clearance .012″,8° | Height of Stack Stabilizer |
|---|---|---|---|
| 5° | .138″ | .007″ | .218 |
| 4° 30′ | .153″ | .009″ | .233 |
| 4° | .172″ | .012″ | .252 |
| 3° 30′ | .197″ | .015″ | .277 |
| 3° | .229″ | .020″ | .309 |
| 2° 30′ | .275″ | .026″ | .355 |

It is not necessary that the sidewalls of the stack stabilizer be straight as they may be curved or otherwise configured as long as the geometry provides for the desired clearance between sidewalls of one stabilizer when nested within the bottom of another stabilizer.

In a modification of the stack stabilizer of the invention, it is also possible to maintain an angle greater than that required to give zero clearance and then reduce clearance as needed through a change in the angle. For example, a stack stabilizer ¾ inch in height above the stack shoulder ledge could start at an 8° angle and end in any of the angles and axial spacing combinations shown in the previous table and give similar results. Additionally, stabilizers 0.330 inches in height at 2°45′ at axial spacing of 0.250 inch give similar results as stabilizers of the same height with sidewalls at 8° for the first 0.166 inch, then vertically straight for 0.164 inch. Additionally, stabilizers 0.242 inches in height at 4°15′ at axial spacing of 0.162 inch give similar results as the combination of 8° for the first 0.166 inch and then vertically straight for 0.076 inch.

The stack stabilizer need not be integral with the stack shoulder and is capable of providing the desired results even if separated therefrom and located at other points on the part utilizing the same principles of geometrics and axial spacing. The preferred embodiment is as illustrated so that restriction of horizontal shift is provided in close proximity to the stack shoulder which controls axial spacing.

In yet another variation a stabilizer having a height of 1½ inch is positioned below the stack shoulder with the following geometrics:

a. $d$ = sine 12° ($\alpha_1$) (0.250 inch)−0.012 = 0.040 (clearance between sidewalls of nested mainbody of parts as in equation 1)

b. $d$ = sine 6° ($\alpha_2$) (0.250 inch) − 0.012 = 0.014 (clearance between sidewalls of main body of stack stabilizer as in equation 1)

c. Height of vertical section necessary to give 0.0 clearance between top of one stack stabilizer and inside of next one in nested position is calculated as:

Clearance at stack stabilizer/sine 6° = 0.014/0.10453 = 0.134 inch d. Height of the 6° sidewall = 1.500−0.134 = 1.366 inch e. Width of offset at top of stack stabilizer = Tan 12° (1.500)− Tan 6° (1.366)= 0.21256 (1.5) − 0.10510 (1.366)=0.175 inch.

In the above example, 0.040 clearance between parts provides for excellent venting of air as the parts are being separated. It is also possible in this configuration to build an offset, similar to 18, near the top of the cover. This feature would be particularly effective in those parts that do not have such an offset at the open end. Moreover, in the above example the 6° angle on the stack stabilizer means builds up an offset sufficiently wide to provide an effective returned side-reverse taper type stack shoulder ledge and additionally provides adequate clearance between sidewalls of the main body of the stack stabilizer while the 0.134 inch high vertical section provides means to allow zero clearance between such stabilizers when nested without causing difficulty in separation of the parts.

In the most preferred embodiment of the stacking device of the invention shown in FIGS. 6 and 7, the zero clearance area 44 is limited to the narrow band at which the base of the stack shoulder 41 remains at the original angle of the stack stabilizer before the undercut is made. This is best seen in FIG. 6 where $\alpha_3$, at the base of the stack shoulder is equal to $\alpha_2$. Also in this embodiment, the height that the sidewall or downwardly depending portion 36 of the stabilizer rises above the stack shoulder 26 should be limited to less than or equal to the height of the stack shoulder designated 52 for optimum results. Extending the portion 36 directly above the stack shoulder allows increased flexure at the undercut for stripping from tooling. The combination of the stack shoulder and stabilizer provides for maximum engagement of the stack shoulder in nested parts.

While the provision of zero clearance between nested stack stabilizers has been discussed and used in most of the preceding examples to indicate details for the stack stabilizer and stack shoulder comprising the stacking device of this invention, it will be understood that actual interference between stabilizers may be employed, or various degrees of clearance between the sidewalls of the stabilizer may be predetermined and varied depending on the size, wall thickness and flexiblity of the parts involved.

The covers described in this invention may be produced by conventional thermoforming techniques including those where suitable thermoplastic materials such as high impact polystyrene, polyvinyl chloride, acrylonitrile-butadiene-styrene, etc. are placed over a suitable mold cavity, preferably with pressurized plug assist, while a vacuum is pulled in the mold whereby a cover substantially conforming to that shown in the drawings is obtained. It will be understood that although the stacking device is most effective in relatively large, flexible parts such as those illustrated, their use is also contemplated in other types of parts depending on part size, flexibility and sidewall thickness of the part. Such parts include more rigid parts with thin-walled construction such as formed drinking cups, meat containers, dairy food containers, etc. However, as part size and flexibility decreases and as sidewall thickness increases, the need for the instant stacking devices diminishes.

In the examples given above, the geometrics were based on a high impact-polystyrene cover having an overall width of 9 inches and an overall height of 2.06 inches having stacking devices each about 1 to 2 inches in width. The part illustrated is designed to cover an 8½ inch plate. In this illustration, the stack height of 100 covers will be not greater than 18.5 inches.

While certain representative embodiments and details have been shown for the purpose of illustrating the invention, it will be apparent to those skilled in the art that various changes and modifications may be made therein without departing from the spirit and scope thereof.

What is claimed is:

1. An integrally formed, nestably stackable thin-walled flexible cover having a topwall, a side wall extending downwardly therefrom and a peripherally continuous flange member extending outwardly to an open end, said sidewall being formed with a plurality of outwardly deformed stacking devices disposed in selected circumferential spaced relation to provide predetermined axial spacing and positive alignment of a plurality of said covers when stacked, each of said stacking devices comprising:

1. a stack stabilizer having a top portion horizontally disposed and extending outwardly from the sidewall, a face portion vertically depending from the top portion and,
2. a stack shoulder having a first horizontally disposed portion depending from the face portion of said stabilizer and extending outwardly from the sidewall to define a stacking ledge, and a reverse tapered member, depending from said stacking ledge and extending inwardly and downwardly to merge with the flange member at the open end of the cover;

the top and face portions of the stack stabilizer, the stacking ledge and the reverse tapered member of the stack shoulder each having returned sides which extend inwardly to merge with the sidewall of the cover;

said stacking devices providing minimal clearance between sidewalls of nested covers at sections of controlled overlap and maintaining contact therebetween during horizontal shift.

2. A cover as defined in claim 1 wherein said stack stabilizer is of sufficient height to provide a predetermined overlap between the top of one nested stack stabilizer within the other.

3. A cover as defined in claim 2 wherein said overlap is sufficient to provide 0.0 inch clearance between the side walls of a plurality of nested stack stabilizers in a stack.

4. A cover as defined in claim 1 wherein the reverse taper member of said stack shoulder merges with an additional intermediate flange member located above said peripheral flange at the open end; said intermediate flange member including a horizontal offset portion.

5. A cover as defined in claim 4 wherein said cover is plastic.

6. A nestably stackable thin-walled flexible plastic cover having a top wall, a sidewall extending downwardly therefrom, a plurality of peripheral flanges, the uppermost flange including a horizontal offset and the lowest flange extending outwardly to an open end; said sidewall being formed with a plurality of outwardly deformed stacking devices disposed in selected circumferential spacing relation and merging with the offset in the uppermost flange;

each stacking device comprising, in combination;

a. a stack stabilizer extending outwardly at a predetermined angle with the sidewall and having a horizontally disposed first portion and a second portion vertically depending from said first portion, the height of said stabilizer being sufficient to provide a predetermined overlap between the top of one nested stack stabilizer within the other and resulting in a clearance of 0.00 inch clearance between the sidewalls of said nested stabilizers; and b. a stack shoulder, integrally formed with and located below said stack stabilizer, having a first horizontally disposed portion extending outwardly and depending from the vertical portion of the stack stabilizer and a reverse tapered member extending inwardly and downwardly and merging with the uppermost flange member at the open end;

said stack stabilizer and said stack shoulder, each having returned sides which extend inwardly and merge with the sidewall of the cover, the combination providing an extended offset that limits the accumulation of clearance around the periphery of the cover in relation to another cover in a stack, maintains contact between nested parts during horizontal shift in the stack and provides minimal clearance between sidewalls of nested parts on areas of minimal overlap.

* * * * *